United States Patent [19]

Takahashi et al.

[11] 4,329,932

[45] May 18, 1982

[54] METHOD OF BURNING FUEL WITH LOWERED NITROGEN-OXIDES EMISSION

[75] Inventors: Yasuro Takahashi; Masayasu Sakai, both of Nagasaki, Japan

[73] Assignee: Mitsubishi Jukogyo Kabushiki Kaisha, Tokyo, Japan

[21] Appl. No.: 156,092

[22] Filed: Jun. 3, 1980

[30] Foreign Application Priority Data

Jun. 7, 1979 [JP] Japan ..... 54/71466

[51] Int. Cl.[3] ..... F23D 1/00

[52] U.S. Cl. ..... 110/347; 110/263; 431/10

[58] Field of Search ..... 110/347, 263; 431/10

[56] References Cited

U.S. PATENT DOCUMENTS

| | | | |
|---|---|---|---|
| 3,727,562 | 4/1973 | Bauer | 431/10 X |
| 3,948,223 | 4/1976 | Benson | 431/10 X |
| 4,021,188 | 5/1977 | Yamagishi et al. | 431/10 X |
| 4,144,017 | 3/1979 | Barsin et al. | 431/10 |
| 4,193,773 | 3/1980 | Staudinger | 431/10 X |

*Primary Examiner*—Edward G. Favors

*Attorney, Agent, or Firm*—Holman & Stern

[57] ABSTRACT

A method of burning fuel with lowered emission of nitrogen oxides comprises feeding pulverized fuel to the main burner in a combustion furnace and additionally feeding pulverized fuel to the region of the furnace where the first fuel is about to conclude its combustion, using inert gas with or without a low oxygen content as a conveying fluid, while supplying oxygen or air to a region downstream of the region for fuel addition.

8 Claims, 2 Drawing Figures

METHOD OF BURNING FUEL WITH LOWERED NITROGEN-OXIDES EMISSION

FIELD OF THE INVENTION

This invention relates to a method for effecting combustion in a pulverized-fuel combustion apparatus, such as a boiler or combustion furnace firing pulverized coal, with lowered emission of nitrogen oxides (hereinafter called "NOx" for simplicity).

DESCRIPTION OF THE PRIOR ART

While a number of means have hitherto been proposed for controllng NOx emissions on fuel combustion, attention has more recently been directed to the combustion that takes advantage of the NOx-reducing tendencies of gas and oil fuels. Shown in FIG. 1, for example, is a typical system based on the latter concept and introduced at the 14th International Combustion Symposium in 1972. Referring to FIG. 1, a combustor 1 is equipped with a burner 2, which is supplied, through a burner inlet tube 3, with air A and methane C as gas fuel, so that the resulting gaseous mixture is burned by a flame F at the open end of the burner 2. The gas fuel methane C is also conducted be a second inlet tube 4 into a point in the burner downstream of the flame F and is then forced through orifices 5, formed in the inner end part of the tube, into the combustion gas. The added fuel causes the combustion gas to burn again, and the latter as exhaust gas G is released out of the combustor. It has been confirmed that in this way about 50% of the thermal NOx produced by the flame F is reduced by the recombustion with additional supply of methane C.

On the other hand, there has been no work of the character reported in connection with coal, and the effects and means of NOx emission control on solid fuels have not been known to the art.

SUMMARY OF THE INVENTION

The present invention has for its object to provide a combustion method whereby the NOx contents of flue gas resulting from the combustion of pulverized fuel, especially finely divided coal, can be decreased.

On the basis of our discovery that pulverized coal, too, has a NOx-reducing action, we propose the introduction of pulverized coal as an additional supply of fuel to combustion gas and the use of an inert gas or a gas with a low oxygen concentration as carrier gas (conveying fluid) with which to blow the fuel into the flame. We have also found that, in order to allow pulverized coal to display fully its NOx-reducing effect, it is desirable to use conditions such that a certain portion of the coal remains unburned after the recombustion. Therefore, we propose further introduction of oxygen or air, after the reducing action has worked and has almost come to its end, to complete combustion of the unburned fuel.

The above and other objects, features, and advantages will become more apparent from the following description taken in conjunction with the accompanying drawings, wherein:

BRIEF DESCRIPTION OF THE DRAWINGS

In FIG. 2, 11 is a horizontal, cylindrical furnace (one meter in diameter and 18 meters in length), 12 is a stack, 13 is a pulverized coal burner, 14 and 21 are first and second hoppers respectively, and 15 and 21 are feeders for supplying, respectively, pulverized coal C1 and C2. A coal-feeding forced draft first fan for supplying primary air A1 together with coal through a first line 17 is indicated at 16. Also shown are a forced draft second fan 18 for supplying secondary air A2 and tertiary air A3, second line 19, first nozzle 20 for injecting tertiary air, third line 23, ejector 24, $N_2$ gas cylinder 25, $O_2$ gas cylinder 26, $N_2$ and $O_2$ flow control valves 27, 28, second nozzle 29 for injecting additional supply of pulverized coal, gas sampling port 30, NOx concentration meter 31, $O_2$ concentration meter 32, and CO concentration meter 33.

Figure 1:
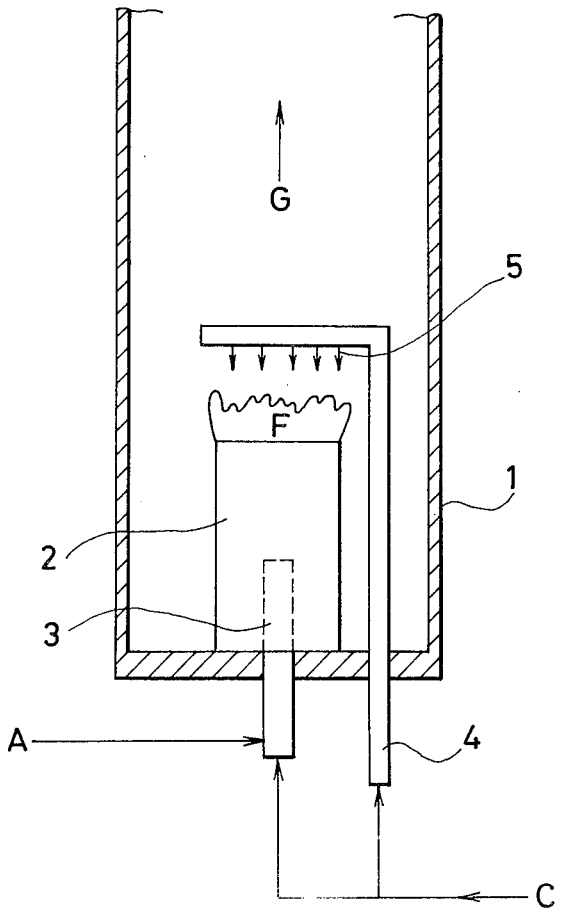
FIG. 1 is a schematic view of a conventional low-NOx combustion system.
Figure 2:
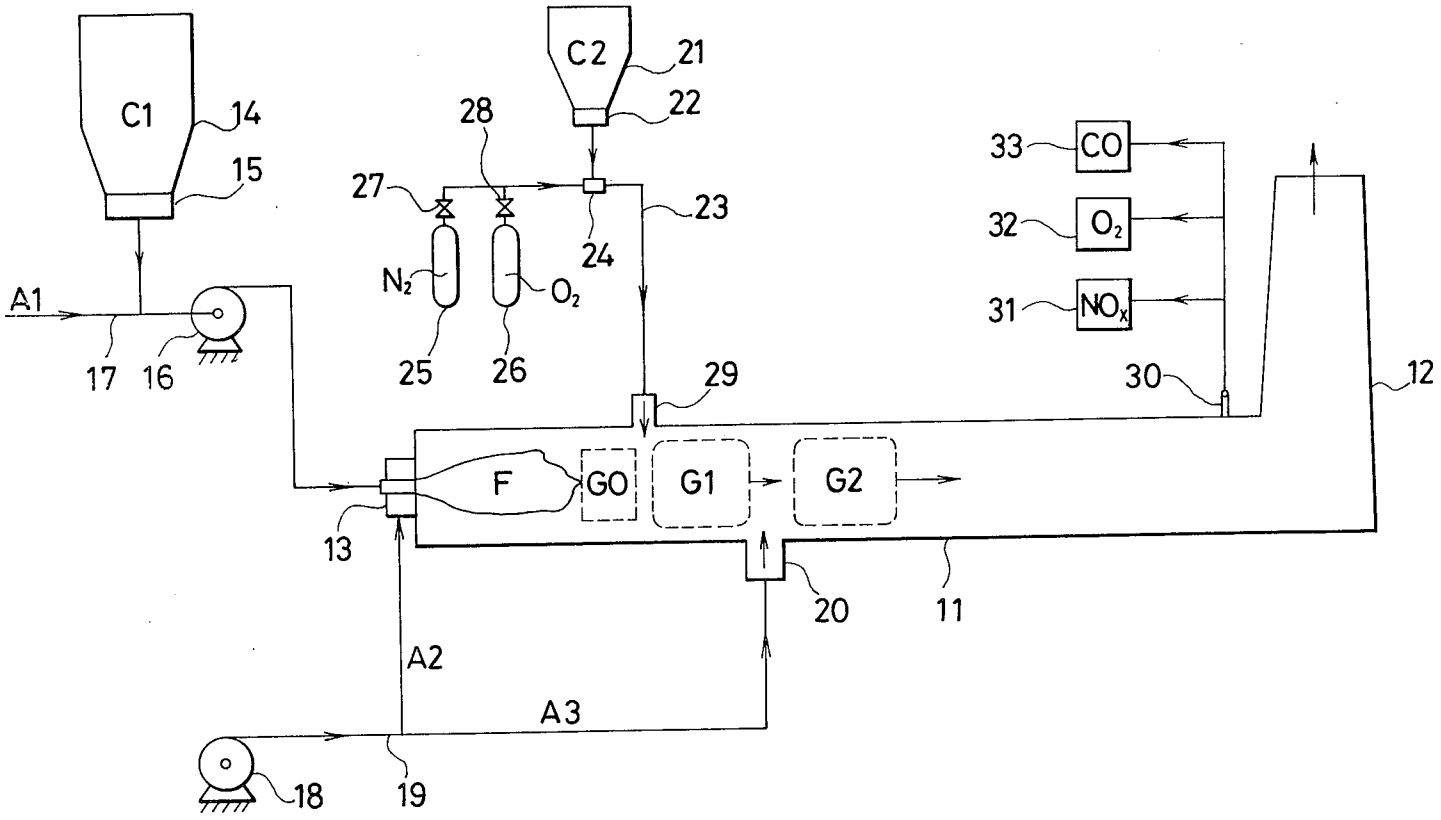
FIG. 2 is a schematic view of an apparatus for practicing the method of this invention.

The symbol F stands for the flame formed by the pulverized coal burner 13, GO is the combustion gas at almost the final stage of combustion, G1 is the gas after recombustion with the introduction of pulverized coal as additional fuel, and G2 is the waste gas after complete combustion of the unburned mixture with the injection of tertiary air from the tertiary-air injection first nozzle 20.

In the apparatus of the construction described, the pulverized coal C1 from the first feeder 15 is conveyed by the primary air A1 as the carrier gas and is fed by the coal-feeding forced draft first fan 16 to the main burner 13, where it is mixed with the second secondary air A2 from the fan 18 and burned together to form the flame F. Into the region of the combustion gas GO in the furnace where the flame is about to die down, additional fuel of pulverized coal C2 from the second feeder 22 is injected through the second nozzle 29, the fuel being conveyed from the ejector 24 onward by the carrier gas which consists of $N_2$ and $O_2$ from the cylinders 25 and 26, adjusted in flow rates and mixed to a predetermined $N_2/O_2$ ratio by the $N_2$ and $O_2$ valves 27 and 28. Here, recombustion with the additional fuel of pulverized coal C2 takes place, and the resulting waste gas G1 flows downstream, where tertiary air A3 for completely burning the unburned content of the gas C1 is injected by the first nozzle 20. Following the conclusion of combustion, the waste gas G2 is released through the stack 12 to the atmosphere. Part of the waste gas is drawn by suction through the gas sampling port 30, and its NOx, $O_2$, and CO concentrations are measured, respectively, by the NOx, $O_2$, and CO concentration meters 31, 32, 33.

In contrast to the formation of the flame F of combustion by the burner 13 which depends on the conventional process of pulverized coal combustion, the procedure of mixing additional fuel of pulverized coal C2 with the mixed $N_2/O_2$ gas being supplied from the ejector 24 through the second nozzle 29 and effecting the recombustion in the zone downstream of the flame F conforms to this invention. In this way the NOx produced by the flame F can be reduced to a half by the recombustion with pulverized coal C2 as added fuel. This effect has been found out as a result of experiments performed in accordance with the invention. It has also been confirmed that the NOx-reducing effect is largely governed by the composition of the carrier gas that conveys the additional fuel of pulverized coal C2.

The results of principal tests conducted with the apparatus in accordance with the invention are summarized in Table 1.

The tests were done by combusting pulverized coal by the burner 13 at a rate of 89 kg/h. The table clearly indicates the NOx-reducing effect attained by use of the additional supply of pulverized coal C2. Test Nos. T-1 and T-2 show ordinary combustion of pulverized coal by the burner 13 with the aid of only primary air A1 and secondary air A2. In T-3 and T-4, by contrast, additional fuel of pulverized coal C2 was supplied, with 100% $N_2$ gas as the carrier gas. A comparison of T-1 and T-3 indicates a decrease in the NOx concentration from 181 ppm to 118 ppm in the latter, and in case of T-2 and T-4, from 148 ppm to 53 ppm. These results demonstrate the NOx-reducing effect of the addition of pulverized coal C2. It is also evident from a comparison of T-3 and T-4 that the conditions of combustion by the burner 13 are such that the lower the $O_2$ concentration of the combustion gas GO the greater the advantageous effect. In case of the highly effective T-4, however, much unburned contents such as CO were left unremoved.

In an effort to achieve complete combustion of the unburned matter the use of tertiary air A3 was included in the conditions of T-4. The test is represented by T-5. The results were satisfactory, and it will be seen that the NOx level was kept substantially the same as that of T-4 and, moreover, CO was almost completely removed.

Tests were then carried out using $O_2$ gas in addition to the inert gas $N_2$ as the carrier gas. The results are summarized in T-6 through T-10. From these results it will be appreciated that the NOx-reducing effect increases in an inverse proportion to the $O_2$ concentration in the carrier gas. In the test T-10 where the carrier gas contained 21% $O_2$ (like ordinary air), the NOx value is rather higher than that of T-2, showing no beneficial effect of pulverized fuel addition. Thus, the $O_2$ concentration in the carrier gas is preferably not more than 10%, more preferably not more than 5%.

In brief, it was found that the conditions used in Test Nos. T-5 to T-7 are most desirable, the conditions in T-4 produce the lowest NOx concentration although the CO concentration is very high, and that the conditions in T-3 and T-8 generally correspond to those of T-4 through T-8.

TABLE 1

| Test No. | Main burner (13) Pulverzd. coal (C1) supply (kg/h) | Main burner (13) Primary (A1) secondary (A2) air flow rate (kg/h) | Nozzle (29) Pulverzd. coal (C2) addition (kg/h) | Nozzle (29) Carrier gas Flow rate (kg/h) | Nozzle (29) Carrier gas Compn. (%) $O_2$ | Nozzle (29) Carrier gas Compn. (%) $N_2$ | Nozzle (20) Tertiary air (A3) flow rate (kg/h) | Combustion waste gas NOx conc. (ppm) | Combustion waste gas $O_2$ conc. (%) | Combustion waste gas CO conc. (ppm) |
|---|---|---|---|---|---|---|---|---|---|---|
| T-1 | 89 | 985 | 0 | 0 | — | — | 0 | 181 | 4.2 | 0 |
| T-2 | 89 | 866 | 0 | 0 | — | — | 0 | 148 | 1.9 | 600 |
| T-3 | 89 | 985 | 8 | 14 | 0 | 100 | 0 | 118 | 2.2 | 800 |
| T-4 | 89 | 866 | 8 | 14 | 0 | 100 | 0 | 53 | 0.3 | >5000 |
| T-5 | 89 | 866 | 8 | 14 | 0 | 100 | 200 | 58 | 4.0 | 30 |
| T-6 | 89 | 866 | 8 | 14 | 2 | 98 | 200 | 64 | 4.0 | 20 |
| T-7 | 89 | 866 | 8 | 14 | 5 | 95 | 200 | 87 | 4.0 | 10 |
| T-8 | 89 | 866 | 8 | 14 | 10 | 90 | 200 | 128 | 4.1 | 3 |
| T-9 | 89 | 866 | 8 | 14 | 15 | 85 | 200 | 149 | 4.0 | 5 |
| T-10 | 89 | 866 | 8 | 14 | 21 | 79 | 200 | 158 | 4.1 | 0 |

What is claimed is:

1. A method of burning fuel with a lower emission of nitrogen oxides, which comprises feeding initial pulverized solid fuel and initial air for combustion to the main burner in a combustion furnace and feeding additional pulverized solid fuel to the region of said furnace where the combustion of the initial fuel is about to conclude, said additional fuel being conveyed by means of an inert gas having from 0 to about 10% oxygen admixed, which conveying gas enters the furnace with the additional fuel.

2. The method of claim 1 wherein a tertiary gas which is oxygen or air is introduced into a region of the furnace which is downstream of the region in which the additional fuel is added, to provide additional air for combustion of any uncombusted fuel.

3. The method of claim 1 or 2 wherein the inert gas is nitrogen.

4. The method of claim 3 wherein the admixed oxygen is present.

5. The method of claim 4 wherein the admixed oxygen is present in an amount up to 5%.

6. The method of claim 3 wherein the conveying gas is substantially nitrogen.

7. The method of claim 1 wherein the conveying gas is substantially nitrogen and a tertiary gas which is air is supplied to a region of the furnace which is downstream of the region in which the additional fuel is added.

8. The method of claim 7 wherein the initial fuel is conveyed by at least part of the initial air for combustion.

* * * * *